US007579998B1

(12) United States Patent
Fang et al.

(10) Patent No.: US 7,579,998 B1
(45) Date of Patent: Aug. 25, 2009

(54) FRACTAL DIPOLE ANTENNA

(75) Inventors: Chiou-Yung Fang, Taipei County (TW); Hua-Ming Chen, Taipei County (TW); Yang-Kai Wang, Taipei County (TW); Chia-Ming Liang, Taipei County (TW); Ching-Shun Wang, Taipei County (TW)

(73) Assignee: Advanced Connection Technology, Inc., Taipei County (TW)

( * ) Notice: Subject to any disclaimer, the term of this patent is extended or adjusted under 35 U.S.C. 154(b) by 12 days.

(21) Appl. No.: 12/033,403

(22) Filed: Feb. 19, 2008

(51) Int. Cl.
*H01Q 9/28* (2006.01)

(52) U.S. Cl. ..... 343/795; 343/700 MS

(58) Field of Classification Search ..... 343/793, 343/795, 700 MS, 725, 726, 727, 728
See application file for complete search history.

(56) References Cited

U.S. PATENT DOCUMENTS

| | | | | |
|---|---|---|---|---|
| 7,113,141 | B2 * | 9/2006 | Almog et al. | 343/795 |
| 7,256,751 | B2 * | 8/2007 | Cohen | 343/792.5 |
| 2005/0264453 | A1 * | 12/2005 | Baliarda et al. | 343/700 MS |
| 2007/0152886 | A1 * | 7/2007 | Baliarda et al. | 343/700 MS |
| 2008/0001838 | A1 * | 1/2008 | Huang et al. | 343/795 |

* cited by examiner

*Primary Examiner*—HoangAnh T Le
(74) *Attorney, Agent, or Firm*—McNees Wallace & Nurick, LLC

(57) ABSTRACT

A fractal dipole antenna includes a dielectric substrate, first and second closed-loop radiating elements, each of which is formed on the dielectric substrate, and first and second fractal radiating elements, each of which is formed on the dielectric substrate and is surrounded by and connected to a respective one of the first and second closed-loop radiating elements.

15 Claims, 5 Drawing Sheets

FRACTAL DIPOLE ANTENNA

BACKGROUND OF THE INVENTION

1. Field of the Invention

This invention relates to an antenna, more particularly to a fractal dipole antenna.

2. Description of the Related Art

In U.S. Pat. No. 7,113,141, there is disclosed a conventional fractal dipole antenna. However, the conventional fractal dipole antenna is not operable within the worldwide interoperability for microwave access (WiMAX) frequency band.

SUMMARY OF THE INVENTION

Therefore, the object of the present invention is to provide a fractal dipole antenna that is operable within the WiMAX frequency band.

According to the present invention, a fractal dipole antenna comprises a dielectric substrate, first and second closed-loop radiating elements, and first and second fractal radiating elements. The first closed-loop radiating element is formed on the dielectric substrate. The first fractal radiating element is formed on the dielectric substrate, and is surrounded by and connected to the first closed-loop radiating element. The second closed-loop radiating element is formed on the dielectric substrate and is spaced apart from the first closed-loop radiating element. The second fractal radiating element is formed on the dielectric substrate, and is surrounded by and connected to the second closed-loop radiating element.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
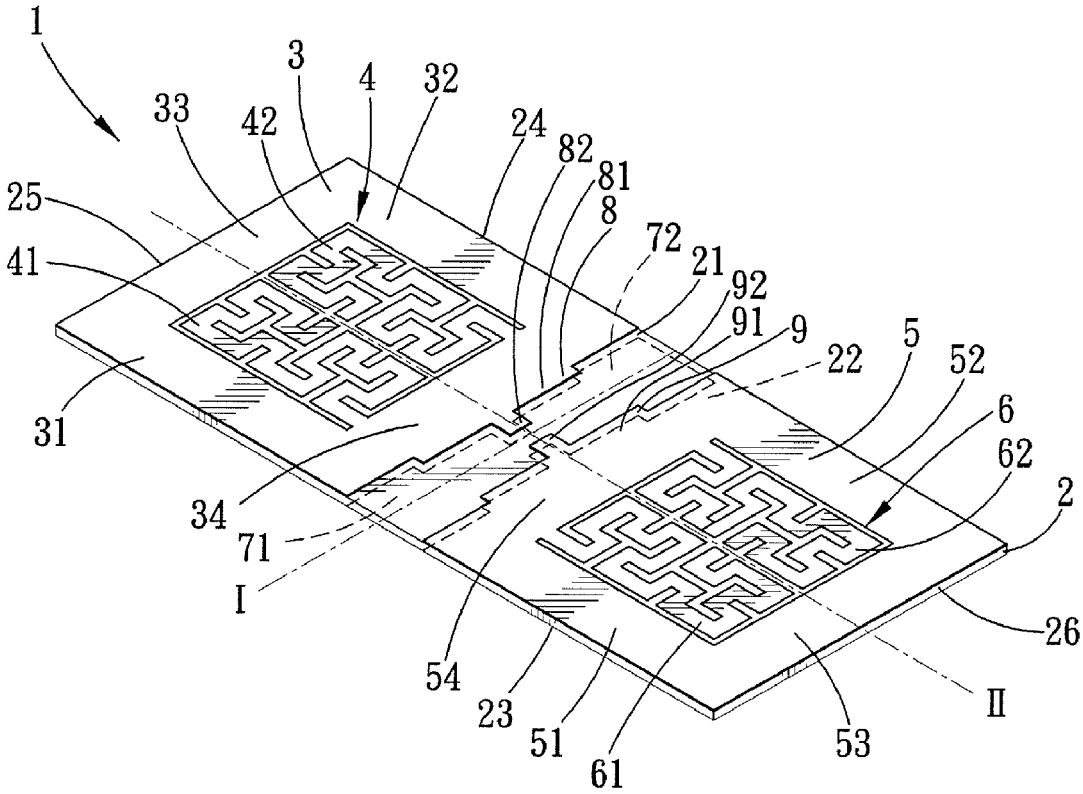
FIG. 1 is a perspective view of the preferred embodiment of a fractal dipole antenna according to the present invention.

Referring to FIG. 1, the preferred embodiment of a fractal dipole antenna 1 according to this invention is shown to include a dielectric substrate 2, first and second closed-loop radiating elements 3, 5, and first and second fractal radiating elements 4, 6.

The fractal dipole antenna 1 of this invention is operable within the worldwide interoperability for microwave access (WiMAX) frequency band, has a small physical size, and is, therefore, applicable to electronic devices (not shown), such as a PDA or a mobile phone.

The dielectric substrate 2 has a generally rectangular shape, opposite first and second surfaces 21, 22, opposite first and second edges 23, 24, and opposite third and fourth edges 25, 26. In this embodiment, the dielectric substrate 2 is an FR-4 substrate.

The first closed-loop radiating element 3 is formed on the first surface 21 of the dielectric substrate 2, has a generally rectangular shape, and includes opposite first and second segments 31, 32 and opposite third and fourth segments 33, 34. The first, second, and third segments 31, 32, 33 of the first closed-loop radiating element 3 are flush with the first, second, and third edges 23, 24, 25 of the dielectric substrate 2, respectively. In this embodiment, each of the first and second segments 31, 32 of the first closed-loop radiating element 3 has a dimension of 16 millimeters, and each of the third and fourth segments 33, 34 of the first closed-loop radiating element 3 has a dimension of 15 millimeters. Such dimensions work favorably toward achieving a small physical size of the fractal dipole antenna 1 of this invention.

The second closed-loop radiating element 5 is formed on the first surface 21 of the dielectric substrate 2, is spaced apart from the first closed-loop radiating element 3, has a generally rectangular shape, and includes opposite first and second segments 51, 52 and opposite third and fourth segments 53, 54. The first, second, and third segments 51, 52, 53 of the second closed-loop radiating element 5 are flush with the first, second, and fourth edges 23, 24, 26 of the dielectric substrate 2, respectively. In this embodiment, the first and second closed-loop radiating elements 3, 5 are symmetrical along a first symmetrical axis (I).

In an alternative embodiment, each of the first and second closed-loop radiating elements 3, 5 has one of a square shape, a circular shape, an elliptical shape, and a triangular shape.

Figure 2:
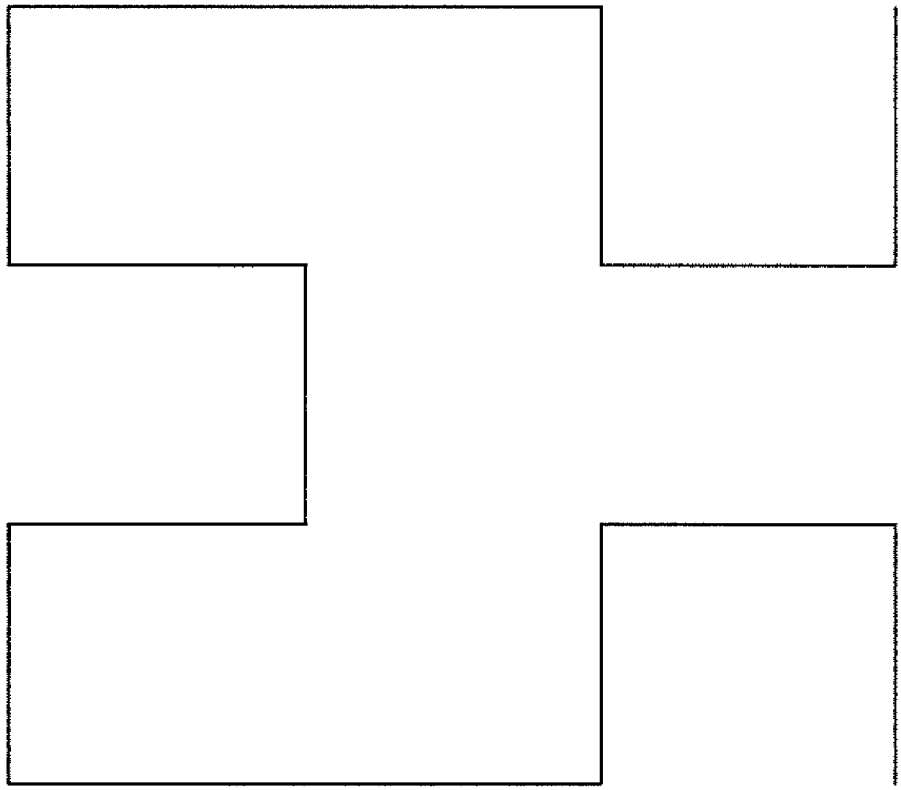
FIG. 2 is a schematic top view of a Hilbert curve.

The first fractal radiating element 4 is formed on the first surface 21 of the dielectric substrate 2, is surrounded by the first closed-loop radiating element 3, and includes spaced apart first and second fractal members 41, 42, each of which is connected to the fourth segment 34 of the first closed-loop radiating element 3. In this embodiment, the first and second fractal members 41, 42 of the first fractal radiating element 4 are symmetrical along a second symmetrical axis (II) transverse to the first symmetrical axis (I). Preferably, with further reference FIG. 2, each of the first and second fractal members 41, 42 of the first fractal radiating element 4 has a shape of a Hilbert curve.

It is noted that an iteration ratio of self-similarity of the shape of each of the first and second fractal members 41, 42 of the first fractal radiating element 4 is two.

In an alternative embodiment, each of first and second fractal members 41, 42 of the first and second fractal radiating element 4 has a shape of one of a Pythagorean tree, a Cantor set, a Sierpinski gasket, a Sierpinski carpet, a Koch curve, a Ceasro curve, a Levy curve, a Peano curve, a Dragon curve, an H-fractal, and a tree fractal.

The second fractal radiating element 6 is formed on the first surface 21 of the dielectric substrate 2, is surrounded by the second closed-loop radiating element 5, and includes spaced apart first and second fractal members 61, 62, each of which is connected to the fourth segment 54 of the second closed-loop radiating element 5. In this embodiment, the second fractal radiating element 6 is symmetrical to the first fractal radiating element 4 along the first symmetrical axis (I).

The fractal dipole antenna 1 further includes spaced apart first and second protrusions 8, 9 formed on the first surface 21 of the dielectric substrate 2 and disposed between the first and second closed-loop radiating elements 3, 5. The first protrusion 8 has a T-shape, and includes a first segment 81 that extends from the fourth segment 34 of the first closed-loop radiating element 3 and that is disposed parallel to the first symmetrical axis (I), and a second segment 82 that extends transversely from the first segment 81 of the first protrusion 8 and along the second symmetrical axis (II) and that is connected to a signal source (not shown). The second protrusion 9 has a T-shape, and includes a first segment 91 that extends from the fourth segment 54 of the second closed-loop radiating element 5 and that is disposed parallel to the first symmetrical axis (I), and a second segment 92 that extends transversely from the first segment 91 of the second protrusion 9 and along the second symmetrical axis (II) and that is connected to an electrical ground (not shown) In this embodiment, the first and second protrusions 8, 9 are symmetrical along the first symmetrical axis (I).

The fractal dipole antenna 1 further includes spaced apart first and second coupling elements 71, 72 that are formed on the second surface 22 of the dielectric substrate 2 and that are disposed between the first and second-closed loop radiating elements 3, 5 and between the first and second protrusions 8, 9. The construction as such permits the fractal dipole antenna 1 of this invention to achieve a wide operating bandwidth. In this embodiment, the first and second coupling elements 71, 72 are symmetrical along the second symmetrical axis (II). Preferably, each of the first and second coupling elements 71, 72 has a T-shape.

Figure 3:
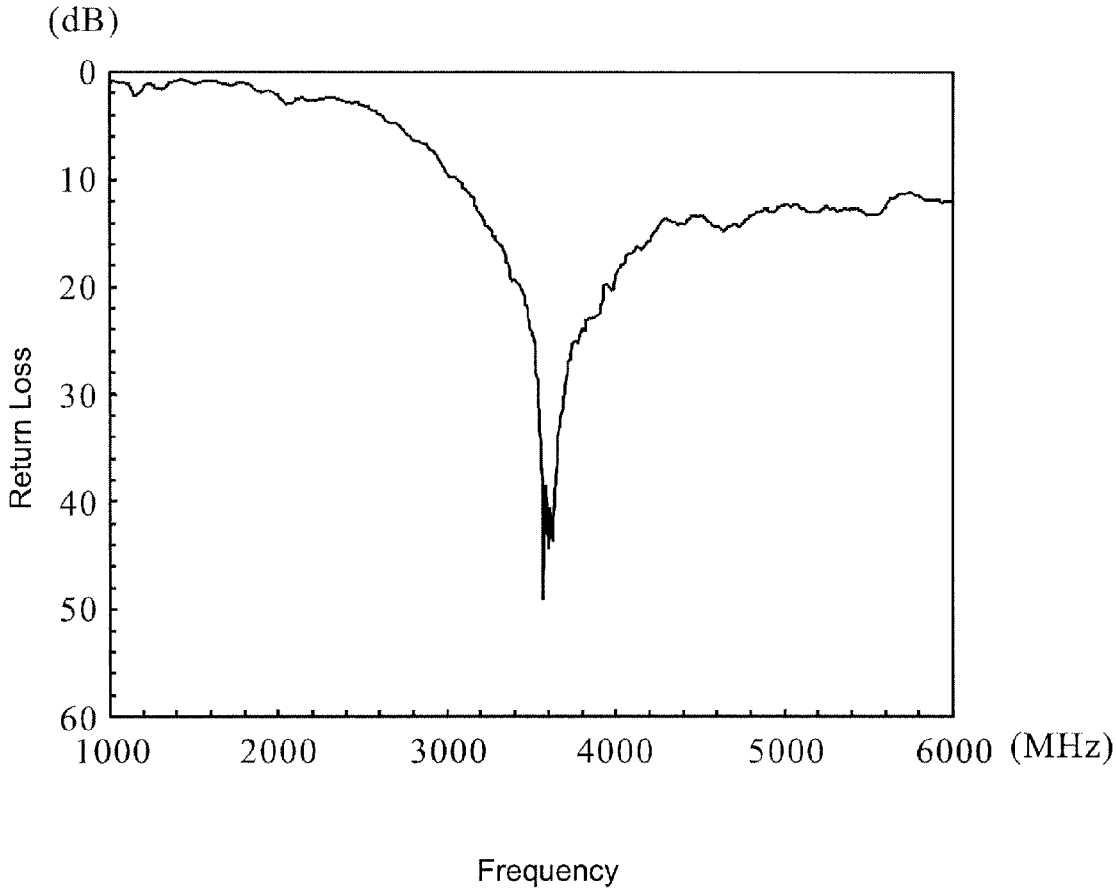
FIG. 3 is a plot illustrating a return loss of the preferred embodiment.
Figure 4:
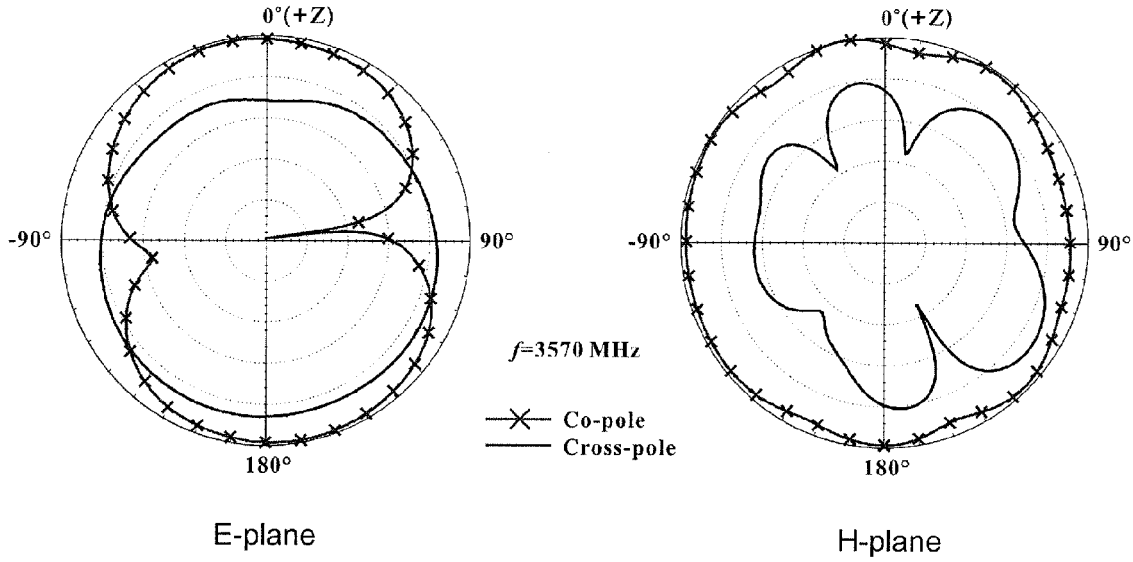
FIG. 4 shows plots of radiation patterns of the preferred embodiment on the E-plane and H-plane.
Figure 5:
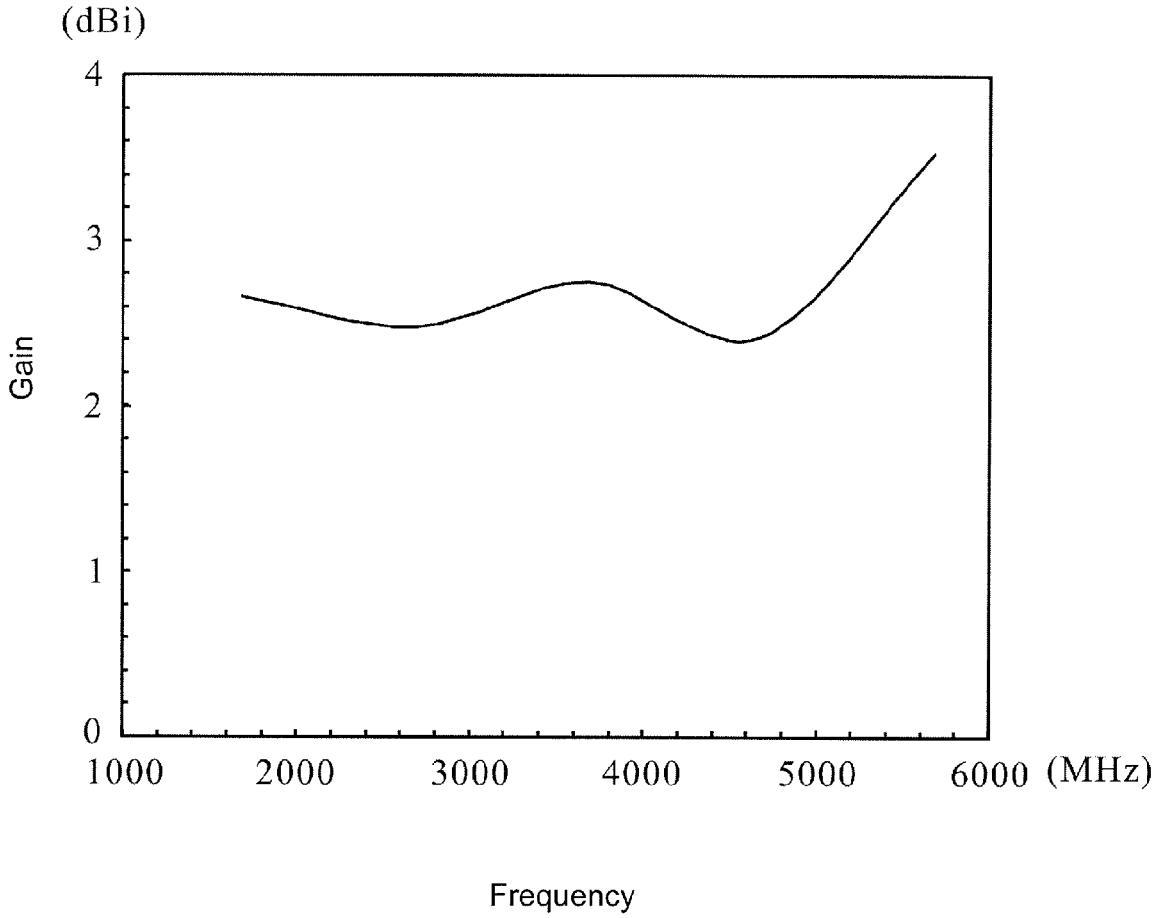
FIG. 5 is a plot illustrating a gain of the preferred embodiment.

Experimental results, as illustrated in FIG. 3, show that, the fractal dipole antenna 1 of this invention indeed has a wide operating bandwidth. Moreover, as illustrated in FIG. 4, the fractal dipole antenna 1 of this invention has a substantially figure-of-eight radiation pattern on the E-plane and a substantially omnidirectional radiation pattern on the H-plane when operated at 3570 MHz. Further, as illustrated in FIG. 5, the fractal dipole antenna 1 of this invention has a high gain.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A fractal dipole antenna, comprising:

a dielectric substrate;

a first closed-loop radiating element formed on said dielectric substrate;

a first fractal radiating element formed on said dielectric substrate, and surrounded by and connected to said first closed-loop radiating element;

a second closed-loop radiating element formed on said dielectric substrate and spaced apart from said first closed-loop radiating element; and a second fractal radiating element formed on said dielectric substrate, and surrounded by and connected to said second closed-loop radiating element.

2. The fractal dipole antenna as claimed in claim 1, wherein said first and second closed-loop radiating elements are symmetrical.

3. The fractal dipole antenna as claimed in claim 1, wherein said first closed-loop radiating element includes a segment disposed closest to said second closed-loop radiating element, and said second closed-loop radiating element includes a segment disposed closest to said first closed-loop radiating element, each of said first and second fractal radiating elements being connected to said segment of a respective one of said first and second closed-loop radiating elements.

4. The fractal dipole antenna as claimed in claim 3, further comprising spaced apart first and second protrusions formed on said dielectric substrate, disposed between said first and second closed-loop radiating elements, extending respectively from said segments of said first and second closed-loop radiating elements, and adapted to be connected respectively to a signal source and an electrical ground.

5. The fractal dipole antenna as claimed in claim 4, wherein each of said first and second protrusions has a T-shape, and includes a first segment that extends from said segment of a respective one of said first and second closed-loop radiating elements, and a second segment that extends transversely from said first segment thereof.

6. The fractal dipole antenna as claimed in claim 4, wherein said first and second protrusions are symmetrical.

7. The fractal dipole antenna as claimed in claim 1, wherein said first and second fractal radiating elements are symmetrical.

8. The fractal dipole antenna as claimed in claim 1, wherein each of said first and second fractal radiating elements includes spaced apart first and second fractal members.

9. The fractal dipole antenna as claimed in claim 8, wherein each of said first and second fractal members of each of said first and second fractal radiating elements has a shape of one of a Hilbert curve, a Pythagorean tree, a Cantor set, a Sierpinski gasket, a Sierpinski carpet, a Koch curve, a Ceasro curve, a Levy curve, a Peano curve, a Dragon curve, an H-fractal, and a tree fractal.

10. The fractal dipole antenna as claimed in claim 8, wherein said first and second fractal members of each of said first and second fractal radiating elements are symmetrical.

11. The fractal dipole antenna as claimed in claim 1, wherein said dielectric substrate has opposite first and second surfaces, said first and second closed-loop radiating elements and said first and second fractal radiating elements being formed on said first surface of said dielectric substrate, said fractal dipole antenna further comprising spaced apart first and second coupling elements formed on said second surface of said dielectric substrate and disposed between said first and second closed-loop radiating elements.

12. The fractal dipole antenna as claimed in claim 11, wherein each of said first and second coupling elements has a T-shape.

13. The fractal dipole antenna as claimed in claim 11, wherein said first and second coupling elements are symmetrical.

14. The fractal dipole antenna as claimed in claim 1, wherein each of said first and second closed-loop radiating elements has one of a square shape, a rectangular shape, a circular shape, an elliptical shape, and a triangular shape.

15. The fractal dipole antenna as claimed in claim 1, wherein said fractal dipole antenna is operable within the worldwide interoperability for microwave access (Wimax) frequency band.

* * * * *